US006338928B1

(12) United States Patent
Tohata

(10) Patent No.: US 6,338,928 B1
(45) Date of Patent: Jan. 15, 2002

(54) NEGATIVE DEVELOPING AGENT AND IMAGE FORMING APPARATUS USING THE SAME

(75) Inventor: Nobuo Tohata, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/651,257

(22) Filed: Aug. 30, 2000

(30) Foreign Application Priority Data

Sep. 21, 1999 (JP) ..... 11-266951

(51) Int. Cl.[7] ..... G03G 9/083

(52) U.S. Cl. ..... 430/106.3; 430/108.7; 399/277

(58) Field of Search ..... 430/106, 108, 430/110, 106.3, 108.7; 399/277

(56) References Cited

U.S. PATENT DOCUMENTS 6,183,927 B1 * 2/2001 Magome et al. ..... 430/110

FOREIGN PATENT DOCUMENTS

| | | |
|---|---|---|
| JP | 3-256052 | 11/1991 |
| JP | 11-194525 | 7/1999 |

* cited by examiner

*Primary Examiner*—John Goodrow
(74) *Attorney, Agent, or Firm*—Foley & Lardner

(57) ABSTRACT

A negative conductive silica and an inorganic oxide are added to a negative magnetic toner so as to obtain a developing agent satisfactory in the rise of the charging and in the stability of charging over the entire life of the developing agent and capable of forming an image free from blurring and a defective transference.

15 Claims, 1 Drawing Sheet

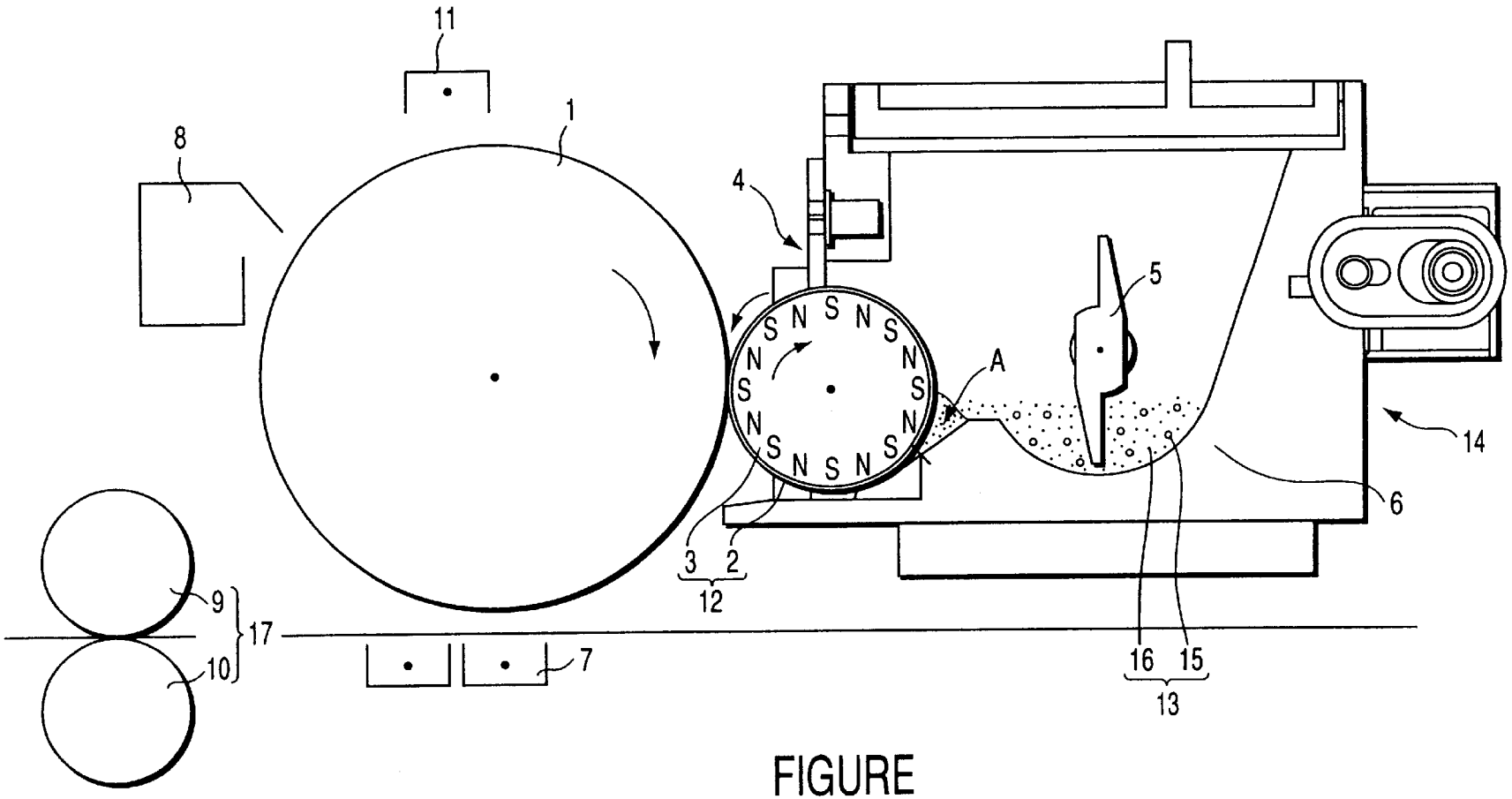
FIGURE

NEGATIVE DEVELOPING AGENT AND IMAGE FORMING APPARATUS USING THE SAME

CROSS-REFERENCE TO RELATED APPLICATIONS

This application is based upon and claims the benefit of priority from the prior Japanese Patent Application No. 11-266951, filed Sep. 21, 1999, the entire contents of which are incorporated herein by reference.

BACKGROUND OF THE INVENTION

The present invention relates to a developing agent used in, for example, an electrophotographic apparatus, particularly, to a negative developing agent.

It is known to the art to use a charge control agent in a magnetic toner. However, since the magnetic toner is superior to the nonmagnetic toner in its charging properties and transfer properties because of its magnetic characteristics, the magnetic toner can be developed even if a charge control agent (CCA) is not contained in the toner. Therefore, a magnetic toner that does not contain a CCA is preferred in recent years in view of reduction of the manufacturing cost and adverse effects given by the CCA to the environment and the human body.

However, when it comes to a magnetic toner that does not contain a CCA, the rise of charging is poor under an environment of a high temperature and a high humidity, giving rise to the phenomenon that the solid image is thinned. Also, when it comes to the life of the toner, the charging amount distribution becomes broad on the side of the large charging amount, giving rise to blurring of the printed character and a poor transference.

When it comes to, for example, a negative magnetic toner, the toner is mixed with a positive magnetic powder so as to allow the charge of the highly charged toner to leak to, for example, the carrier and to the developing device, so as to prevent the highly charged side from becoming broad.

Since the magnetic powder exhibits a strong agglomeration capability, the magnetic powder is unlikely to be dispersed on the surface of the toner when the toner is added to and mixed with the toner. Also, even if once dispersed, the magnetic powder is liberated from the toner so as to be present independently. In such a case, since the magnetic powder is positive, which is opposite to the polarity of the toner, the magnetic powder is developed in the non-image portion of the photoreceptor. What should also be noted is that magnetite, ferrite or the like is used in general as the magnetic powder. Since such a magnetic powder is black, the magnetic powder appears as a fogging after the transference. Since the size of the magnetic powder developed in the non-image portion of the photoreceptor is small, the magnetic powder passes through the blade when the magnetic powder is present together with the toner, making it difficult to remove the magnetic powder by cleaning with the blade. It follows that, during the life of the developing agent, the magnetic powder tends to bring about filming within the photoreceptor.

An additional difficulty inherent in the prior art is that the flowability of the toner is impaired so as to increase the amount of the toner remaining inside the cartridge.

BRIEF SUMMARY OF THE INVENTION

An object of the present invention, which has been achieved in view of the situation described above, is to provide a developing agent satisfactory in the charging at start-up and in the stability of the charging over the entire life of the developing agent, and capable of forming a satisfactory image free from blurring of the character and a defective transference and having a sufficiently high image density.

Another object of the present invention is to provide an image forming apparatus capable of forming a satisfactory image free from blurring of the character and a defective transference and having a sufficiently high image density by using a developing agent satisfactory in the charging at start-up and in the stability of the charging over the entire life of the developing agent.

According to a first aspect of the present invention, there is provided a negative developing agent comprising a carrier and a negative magnetic toner including a negative magnetic toner particle containing a magnetic powder and a binder resin; a negative conductive silica; an inorganic oxide, and not containing a charge control agent.

According to a second aspect of the present invention, there is provided a negative developing agent comprising a negative toner particle containing a coloring agent and a binder resin; a negative conductive silica; and a negative magnetic toner containing an inorganic oxide but not containing a charge control agent.

Further, according to a third aspect of the present invention, there is provided an image forming apparatus, comprising:

at least one image carrier;

a developing device having a hollow cylindrical rotatable sleeve for holding a developing agent and a developing roller including a magnetic roller having a plurality of magnetic poles and rotatable independent of the sleeve, the developing agent including a carrier and a negative magnetic toner containing a negative magnetic toner particle having a magnetic powder and a binder resin, a negative conductive silica, an inorganic oxide, not containing a charge control agent;

a transfer device, a cleaning device, the developing device, transfer device and cleaning device being arranged to face the image carrier in the order mentioned; and a fixing device arranged downstream of the transfer device and having a pair of fixing rollers.

The developing agent of the present invention is satisfactory in the charging at start-up and in the stability of the charging over the entire life of the developing agent and is capable of forming a satisfactory image free from blurring of the character and a defective transference.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGURE schematically shows the construction of an image forming apparatus according to one embodiment of the present invention.

DETAILED DESCRIPTION OF THE INVENTION

A negative developing agent according to a first embodiment of the present invention is a developing agent that does not contain a charge control agent. Specifically, a negative magnetic toner particle, a negative conductive silica and an inorganic oxide, the negative magnetic toner particle containing a coloring agent, a binder resin and a magnetic powder, are mixed in the negative developing agent of the present invention.

According to the present invention, a negative conductive silica is added to the surface of a negative toner particle, making it possible to suppress the increase in the charging amount over the entire life of the developing agent under a low temperature and a low humidity so as to prevent reduction of ID, though a charge control agent is not contained in the developing agent. It should also be noted that the negative conductive silica is excellent in its conductivity and, thus, produces an effect greater than that produced by the positive magnetic powder used in the past. Also, since the polarity of the conductive silica is negative, it is rare for the conductive silica to be developed in the non-image portion and appear as a fogging even where the conductive silica is present in a liberated form from the toner. Further, the flowability of the toner particles is not impaired, and the rise of charging is satisfactory under an environment of a high temperature and a high humidity.

As described above, the negative conductive silica produces its effect by releasing the charge accumulated in the toner to the air, to the carrier or to the developing device. The particular effect is further promoted by satisfying some additional requirements.

One of the conditions is to control the diameter of the negative conductive silica. In general, the surface of the toner manufactured by the pulverizing method is irregular. It is desirable for the conductive silica particle to have a diameter large enough not to enter easily the concave portion on the surface of the toner. Where the negative conductive silica particle has a large particle diameter, the negative conductive silica acting on the toner surface is efficiently brought into contact with the other portion. However, it is desirable not to use unduly large particles of the negative conductive silica so as not to inhibit the contact charging between the toner and the carrier. Also, in order to ensure sufficient dispersion in the adding and mixing step, it is desirable not to use the negative conductive silica having an excessively large proportion of the small diameter portion in the particle size distribution. Under the circumstances, it is desirable for the negative conductive silica particles to contain 50% by volume of particles having a diameter of 0.02 to 2.0 $\mu$m, more preferably 0.03 to 1.5 $\mu$m. Also, the negative conductive silica particles should desirably be contained in an amount of 0.5 to 2% by weight, more preferably 0.10 to 1% by weight, based on the total amount of the developing agent.

Another condition is to ensure sufficiently the flowability of the toner. In the present invention, the negative conductive silica and a hydrophobic inorganic oxide are used in combination so as to obtain a sufficient toner flowability. As a result, the contact efficiency of the negative conductive silica with the carrier or the developing device is increased, and the contact charging efficiency between the toner and the carrier is improved so as to obtain a stable charging characteristics under every environment.

Under the circumstances, it is desirable for the volume average diameter of the hydrophobic inorganic oxide to fall within a range of between 4 nm and 20 nm, more preferably, between 6 nm and 16 nm. It is also desirable for the hydrophobic inorganic oxide to be added in an amount of 0.1 to 1.0% by weight, preferably 0.15 to 0.60% by weight, based on the total weight of the toner.

As a negative conductive silica, it is possible to use a silica fine powder having the surface covered with a mixture of, for example, tin oxide and antimony so as to impart conductivity to the silica fine particles.

The hydrophobic inorganic oxide is added in order to improve the flowability of the developing agent. The inorganic oxide used in the present invention includes, for example, silicates such as silicon dioxide, aluminum silicate, sodium silicate, potassium silicate, zinc silicate and magnesium silicate; and metal oxides such as zinc oxide, titanium oxide, aluminum oxide, zirconium oxide, strontium oxide, and barium oxide. These inorganic oxides are made hydrophobic by applying a hydrophobic agent such as dimethyl dichlorosilane, hexamethyl disilazane, silicone oil or octyl trimethoxy silane to the surface of the inorganic oxide so as to bring about a chemical reaction and, thus, to apply a surface treatment to the inorganic oxide.

A known mixing apparatus can be used for mixing the additive. For example, it is possible to use a Henschel mixer or a super mixer.

As a resin binder, it is possible to use copolymer of styrene or its substituted derivative or an acrylic resin, which was used in the past as the binder resin for the negative toner.

The copolymer of styrene and its substituted derivative used in the present invention includes, for example, polystyrene homopolymer, hydrogenated styrene resin, styrene-isobutylene copolymer, styrene-butadiene copolymer, acrylonitrile-butadiene-styrene terpolymer, acrylonitrile-styrene-acrylic acid ester terpolymer, styrene-acrylonitrile copolymer, acrylonitrile-acryl rubber-styrene terpolymer, acrylonitrile-chlorinated polystyrene-styrene terpolymer, acrylonitrile-EVA-styrene terpolymer, styrene-p-chlorostyrene copolymer, styrene-propylene copolymer, styrene-butadiene rubber copolymer, styrene-maleic acid ester copolymer, styrene-isobutylene copolymer, and styrene-maleic anhydride copolymer.

On the other hand, the acrylic resin used in the present invention includes, for example, polyacrylate, polymethyl acrylate, polyethyl acrylate, poly-n-butyl methacrylate, polyglycidyl methacrylate, poly-fluorine-containing acrylate, styrene-methacrylate copolymer, styrene-butyl methacrylate copolymer, and styrene-acrylic acid ester copolymer.

The binder resin used in the present invention also includes, for example, polyvinyl chloride, polyvinyl acetate, polyethylene, polypropylene, polyester, polyurethane, polyamide, epoxy resin, phenolic resin, urea resin, polyvinyl butyral, polyacrylic acid resin, rosin, modified rosin, terpene resin, aliphatic or alicyclic hydrocarbon resin, aromatic series petroleum resin, chlorinated paraffin and paraffin wax. These binder resins can be used singly or in the form of a mixture of at least two resins.

In general, the composition of the magnetic toner is as follows.

Specifically, the magnetic powder consists of, for example, ferrite or magnetite and should desirably be contained in the toner particle in an amount of 20 to 60% by weight, preferably 25 to 50% by weight.

It is desirable for the polymer, copolymer or polymer blend used to contain at least 40% by weight of vinyl aromatic monomer represented by styrene or acrylic monomer.

In the present invention, the binder resin described above can be added to the magnetic toner in an amount of 40 to 80% by weight. If the amount of the binder resin is smaller than the lower limit of the range noted above, the electric properties and the fixing properties of the magnetic toner are lowered. On the other hand, if the amount of the binder resin exceeds the upper limit of the range noted above, the amount of the magnetic powder is made relatively small, with the result that the magnetic properties of the toner are rendered insufficient so as to make the sleeve transfer characteristics unsatisfactory, thereby lowering the developing properties.

Further, it is possible in the present invention to add a coloring agent and a flowability modifying agent to the magnetic toner, if necessary. The flowability modifying agent used in the present invention, which may be mixed with the toner, includes, for example, a colloidal silica and metal salts of fatty acid.

Also, it is possible to add a filler such as calcium carbonate or a fine powdery silica in an amount of 0.5 to 20% by weight relative to the total toner amount to the magnetic toner in order to increase the volume of the magnetic toner. It is also possible to add a flowability increasing agent such as a Teflon finer powder in order to prevent the toner particles from being agglomerated and, thus, to improve the flowability. Further, it is possible to add about 0.5 to 5% by weight based on the total amount of the toner particle of a wax-like material such as a low molecular weight polyethylene, a low molecular weight polypropylene, a microcrystalline wax, or a sazol wax to the toner particle in order to improve the releasability in the thermal fixing step.

For the manufacture of the developing agent of the present invention, it is possible to employ the method of sufficiently kneading the raw materials by a thermal kneading machine such as a heat roll, a kneader, or an extruder, followed by mechanically pulverizing the kneaded material and subsequently classifying the pulverized material to obtain a desired developing agent, a method of dispersing the raw materials such as a magnetic powder in a binder resin solution, followed by spraying and drying the dispersion to obtain a desired developing agent, or a polymerization toner manufacturing method in which predetermined materials are mixed with the monomer that is to form a binder resin to form an emulsion, followed by polymerizing the resultant emulsion so as to obtain a magnetic toner.

It should be noted that the combination of the negative toner particle and the negative conductive silica used in the present invention is not applied to a magnetic developing agent alone, but is also applied to a nonmagnetic developing agent.

According to a second aspect of the present invention, there is provided a negative developing agent, comprising a negative toner particle containing a coloring agent and a binder resin, a negative conductive silica, and an inorganic oxide.

The developing agent according to the second aspect of the present invention can be obtained like the developing agent of the first aspect, except that a magnetic powder is not used in the negative developing agent of the second aspect.

According to the developing agent of the present invention, which does not contain a magnetic powder, it is possible to make the rise of charging extremely improved because desirable flowability can be combined with charging properties in a magnet rotating developing system which especially has a rare chance to charge by adding a negative magnetic toner particle, a negative conductive silica and an inorganic oxide.

It is desirable for the negative conductive silica used in the present invention to have a 50% volume diameter of 0.02 to 2 $\mu$m and a resistivity of 50 to 500 $\Omega\cdot$cm, and to be added in an amount of 0.05 to 2% by weight based on the total weight of the toner particle.

According to a third aspect of the present invention, there is provided an image forming apparatus, comprising:

at least one image carrier;

a developing device having a hollow cylindrical rotatable sleeve for holding a developing agent and a developing roller including a magnetic roller having a plurality of magnetic poles and rotatable independent of said sleeve;

a transfer device, a cleaning device, said developing device, transfer device and cleaning device being arranged to face said image carrier in the order mentioned; and a fixing device arranged downstream of said transfer device and having a pair of fixing rollers;

wherein said developing agent includes a carrier and a negative magnetic toner containing a negative magnetic toner particle having a magnetic powder and a binder resin, a negative conductive silica, and an inorganic oxide, not containing a charge control agent.

The image forming apparatus of the present invention makes it possible to obtain sufficiently the effect produced by the developing agent according to the first aspect of the present invention so as to form a satisfactory image.

FIGURE schematically shows the construction of the image forming apparatus according to one embodiment of the present invention.

As shown in the drawing, the image forming apparatus of the present invention comprises essentially a photoreceptor drum 1 acting as an image carrier, a developing device 14, a transfer device 7, a cleaning device 8, a charging device 11 and a fixing device 17. These developing device 14, transfer device 7, cleaning device 8, and charging device 11 are arranged to face the photoreceptor drum 1 in the order mentioned in the rotating direction of the photo-receptor drum 1. On the other hand, the fixing device 17, which consists of a pair of fixing rollers 9 and 10, is arranged downstream of the transfer device 7.

The photoreceptor drum 1, which holds an electrostatic latent image on the surface, is rotated in the direction denoted by an arrow. The developing device 14 arranged to face the photoreceptor drum 1 is constructed as follows. Specifically, the developing device 14 comprises a developing agent housing section 6 that is formed integral with an envelope to which a toner cartridge can be mounted. Housed in the developing agent housing section 6 is a developing agent 13 containing a negative toner 16 and a carrier 15. The negative toner 16 is prepared by adding a negative conductive silica and an inorganic oxide to a negative magnetic toner particle containing a coloring agent, a binder resin and a magnetic power, and not containing a charge control agent. The developing roller 12 is arranged at the lower end portion of the developing agent housing section 6 in a manner to face the photoreceptor drum 1. The developing roller 12 consists of a hollow cylindrical developing sleeve 2 made of a nonmagnetic material and a magnet roller 3 housed in the sleeve 2 and extending in the axial direction of the sleeve 2 and having a plurality of magnetic poles. The magnet roller 3 is arranged coaxial with the sleeve 2 and these magnet roller 3 and the sleeve 3 are rotatable relative to each other. In the developing device of the particular construction, the developing sleeve 2 is rotatable in the counterclockwise direction, and the magnet roller 3 is rotatable in the clockwise direction in the drawing. As a result, the rotating direction of the developing agent about its own axis is equal to the transfer direction of the developing agent so as to make it possible to increase the transfer amount, leading to a developing treatment at a high speed. A reference numeral 4 denotes a developing agent regulating blade made of a nonmagnetic material. On the other hand, a reference numeral 5 denotes a stirrer. The developing agent 12 is stirred by the stirrer 5 so as to prevent the agglomeration of the developing agent. At the same time, the stirrer 5 serves to move the developing agent toward the developing roller 12.

The gap between the photoreceptor drum 1 and the developing sleeve 2 is set at 0.35 mm. On the other hand, the gap between the developing agent regulating blade 4 and the developing sleeve 2 is set at 0.30 mm.

The magnetic toner is stirred by the stirrer 5 and moved so as to be supplied to a magnetic suction region A of the developing agent. The magnetic toner magnetically sucked in the magnetic suction region A of the developing agent is adsorbed on the developing sleeve 2, and in accordance with rotation of the magnet roller 3, the magnetic carrier 15 is rotated and stirred together with the toner 16 so as to be charged.

A ratio of the toner weight to the weight of the developing agent on the developing sleeve 2, i.e., a toner specific concentration, is about 20% to 60% and, thus, the toner amount relative to the magnetic carrier is large in the present invention, compared with the two component developing system of the conventional magnet stationary type. It should also be noted that, in the conventional magnet stationary developing system, inconveniences such as a carrier drawing and reduction in the concentration tend to be generated unless the toner specific concentration is maintained at a desired value ±1%, making it necessary to strictly control the toner specific concentration. In the magnet rotation developing system of the present invention, however, no inconvenience in the image does not take place regardless of the fluctuation in the toner specific concentration ±20% by weight. The developing agent transferred onto the sleeve 2 passes through the developing agent regulating blade 4 so as to form a predetermined thickness of a developing agent layer. Then, the electrostatic latent image formed on the surface of the photoreceptor drum 1 is developed with the developing agent so as to form a developing agent image.

The developing agent image is transferred onto a transfer sheet in the transfer device 7. Further, the transfer sheet having the developing agent image transferred thereonto is transferred to the fixing device 17 so as to be pressurized under heat by the fixing rollers 9 and 10, with the result that the developing agent image is fixed to the transfer sheet.

EXAMPLES

The present invention will now be described more in detail with reference to Examples which follow.

Example 1

Composition A given below was melted and kneaded under heat, followed by cooling the kneaded mass and subsequently pulverizing the cooled mass and classifying the resultant powder so as to obtain toner particle:

Composition A

Styrene acrylic resin: CPR100 . . . 50%

Magnetic powder: magnetite . . . 50%

0.05 part by weight of a negative conductive silica having a volume 50% diameter of 0.05 μm and 0.5 part by weight of hydrophobic silica having a volume average diameter of 20 nm were mixed with 100 parts by weight of toner particles so as to obtain a toner.

Then, 100 parts by weight of the toner thus prepared and 100 parts by weight of a carrier consisting of an iron powder coated with silicon and having a volume average diameter of 80 μm were kept stirred for one hour by using a ball mill so as to obtain a developing agent. Various evaluation tests were applied to the developing agent thus obtained so as to evaluate the developing agent as follows:

(1) Evaluation of initial image density under high temperature and high humidity (H/H) environment:

A 100% solid image having a size A3 was evaluated under a temperature of 30° C. and a humidity of 85% by using ED2460 modified machine manufactured by Toshiba Corporation, Japan, with the result as shown in Table 1. The mark ○ in Table 1 denotes that ID was not smaller than 1.3. The mark Δ denotes that ID was not smaller than 1.2 and less than 1.3. Further, the mark X denotes that ID was less than 1.2.

(2) Evaluation of fogging:

Copying was performed on a white paper sheet by using ED2460 modified machine manufactured by Toshiba Corporation, Japan, with the result as shown in Table 1. The mark ○ in Table 1 denotes that fogging was not larger than 0.5%. The mark A denotes that fogging was 0.6 to 2%. Further, the mark X denotes that fogging exceeded 2%.

(3) Evaluation of cleaning properties:

A 100% solid image was developed on a photo-receptor by using the evaluating machine described above. The amount of the toner that was not transferred onto a paper sheet and caught by the cleaning blade was measured with the transfer current dropped, and the surface of the photoreceptor after passing through the blade was taped so as to measure the reflectance, with the result as shown in Table 1. The mark ○ in Table 1 denotes that the reflectance was not higher than 1%. The mark Δ denotes that the reflectance was 1 to 5%. Further, the mark X denotes that the reflectance exceeded 5%.

(4) Flowability:

20 g of the toner was put on sieves of 60 meshes, 100 meshes and 200 meshes and vibrated for 30 seconds by using a powder tester manufactured by Hosokawa Micron Inc., Japan, so as to measure the residual amount (g) of the toner after the vibration. Table 1 shows the result.

(5) Charging amount distribution:

A developing agent after copying on 50,000 Toshiba test charts was sampled from within the developing device and measured by an Easpert Analyzer manufactured by Hosokawa Micron Inc., Japan, so as to evaluate the charging amount distribution. ED2460 modified machine manufactured by Toshiba Corporation, Japan, with the result as shown in Table 1.

Examples 2 to 5

A developing agent was obtained as in Example 1, except that a conductive silica differing in the 50% diameter and the addition amount from the conductive silica used in Example 1 and a hydrophobic silica differing in the 50% diameter from the hydrophobic silica used in Example 1 were used in these Examples.

Evaluation tests equal to those applied in Example 1 were also applied to the developing agents obtained in these Examples. Table 1 also shows the results.

Comparative Examples 1 to 7

Developing agents were obtained as in Example 1, except that these Comparative Examples differed from Example 1 in the conducting agent and the inorganic oxide added to the toner particles.

Evaluation tests equal to those applied in Example 1 were also applied to the developing agents obtained in these Comparative Examples. Table 1 also shows the results.

TABLE 1

| | Inner addition | | Conductivity agent | | | | |
|---|---|---|---|---|---|---|---|
| | CCA amount (%) | Magnetic powder amount (%) | Kind | Polarity | 50% diameter (μm) | Resistivity (Ωm) | Addition Amount (%) |
| Example 1 | None | 50 | Conductive silica | Negative | 0.05 | 200 | 0.05 |
| Example 2 | None | 50 | Conductive silica | Negative | 2 | 200 | 2 |
| Comparative Example 1 | None | 50 | None | — | — | — | — |
| Comparative Example 2 | None | 50 | Magnetic powder | Positive | 200 | 1 × E7 | 2 |
| Example 3 | None | 50 | Conductive silica | Negative | 0.05 | 200 | 0.03 |
| Example 4 | None | 50 | Conductive silica | Negative | 0.05 | 200 | 5 |
| Comparative Example 3 | None | 50 | Conductive silica | Positive | 0.05 | 200 | 0.05 |
| Example 5 | None | 50 | Conductive silica | Negative | 0.05 | 1000 | 0.03 |

| | Inorganic oxide | | Properties | | Life image characteristics | | |
|---|---|---|---|---|---|---|---|
| | Addition amount (%) | 50% diameter (μm) | Flowability (g) | Charging amount distribution | H/HID | Fogging | Cleaning properties |
| Example 1 | 0.5 | 20 | 5 | Sharp | ○ | ○ | ○ |
| Example 2 | 0.5 | 4 | 7 | Sharp | ○ | ○ | ○ |
| Comparative Example 1 | 0.3 | 20 | 4 | Broad | X | X | ○ |
| Comparative Example 2 | 0.5 | 20 | 22 | Broad | Δ | X | X |
| Example 3 | 0.5 | 20 | 9 | Broad | X | ○ | ○ |
| Example 4 | 0.5 | 20 | 4 | Broad | ○ | Δ | Δ |
| Comparative Example 3 | 0.5 | 20 | 6 | Broad | ○ | Δ | X |
| Example 5 | 0.5 | 20 | 4 | Broad | ○ | Δ | ○ |

The experimental data given in Table 1 supports that a practical developing agent can be obtained by using a negative conductive silica as a conducting agent, even if a charge control agent is not used.

Also, it is desirable for the negative conductive silica to have a resistivity falling within a range of between 50 and 500 Ω·cm, to be added in an amount of 0.05 to 2%, and to have a 50% pore falling within a range of between 0.02 μm and 2 μm.

If the resistivity exceeds 500 Ω·cm, the charging amount distribution tends to become broad. Also, where the addition amount is smaller than 0.05%, the charging amount tends to be increased so as to lower ID. Further, if the addition amount exceeds 2% by weight, the charging amount distribution tends to become broad so as to generate fogging and cause the cleaning properties to be rendered poor.

It is desirable for the toner flowability to fall within a range of between 2 g and 17 g. Where the toner flowability is lower than 2 g, fogging tends to take place. On the other hand, if the toner flowability exceeds 17 g, the cleaning properties tend to be rendered poor so as to increase the residual amount of the toner within the cartridge.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A negative developing agent comprising a negative magnetic toner particle including a carrier and a negative magnetic toner containing a coloring agent, a magnetic powder and a binder resin; a negative conductive silica; an inorganic oxide and not containing a charge control agent.

2. The negative developing agent according to claim 1, wherein said negative conductive silica consists of a silica fine powder covered with a mixture of tin oxide and antimony.

3. The negative developing agent according to claim 1, wherein said negative conductive silica has a 50% volume diameter of 0.02 to 2 $\mu$m, and a resistivity of 50 to 500 $\Omega\cdot$cm, and is added in an amount of 0.05 to 2% by weight.

4. The negative developing agent according to claim 1, wherein a magnetic powder is added in an amount of 20 to 60% by weight based on the total weight of said toner particle.

5. The negative developing agent according to claim 1, wherein said inorganic oxide has a volume average diameter of 4 to 20 nm and is added in an amount of 0.1 to 1% by weight based on the total weight of said toner particle.

6. An image forming apparatus, comprising:

at least one image carrier;

a developing device having a hollow cylindrical rotatable sleeve for holding a developing agent and a developing roller including a magnetic roller having a plurality of magnetic poles and rotatable independent of said sleeve, said developing agent including a negative magnetic toner containing a carrier and a negative magnetic toner particle having a magnetic powder and a binder resin, a negative conductive silica, and an inorganic oxide does not contain a charge control agent;

a transfer device, a cleaning device, said developing device, transfer device and cleaning device being arranged to face said image carrier in the order mentioned; and a fixing device arranged downstream of said transfer device and having a pair of fixing rollers.

7. The image forming apparatus according to claim 6, wherein said negative conductive silica consists of a fine silica powder covered with a mixture of tin oxide and antimony.

8. The image forming apparatus according to claim 6, wherein a toner specific concentration of said toner to said carrier falls within a range of between 20 and 60%.

9. The image forming apparatus according to claim 6, wherein said negative conductive silica has a 50% volume diameter of 0.02 to 2 $\mu$m, and a resistivity of 50 to 500 $\Omega\cdot$cm, and is added in an amount of 0.05 to 2% by weight.

10. The image forming apparatus according to claim 6, wherein a magnetic toner is added in an amount of 20 to 60% by weight based on the total weight of said toner particle.

11. The image forming apparatus according to claim 6, wherein said inorganic oxide has a volume average diameter of 4 to 20 nm and is added in an amount of 0.1 to 1% by weight based on the total weight of said toner particle.

12. A negative developing agent comprising a negative magnetic toner particle including a carrier and a negative magnetic toner containing a coloring agent, a magnetic powder and a binder resin; a negative conductive silica; and an inorganic oxide, wherein the negative developing agent does not contain a charge control agent, and wherein said magnetic powder is substantially contained inside said negative magnetic toner.

13. The negative developing agent according to claim 12, wherein the coloring agent and the binder resin are substantially contained inside said negative magnetic toner.

14. The negative developing agent according to claim 12, wherein the negative conductive silica is attached to an exterior surface of the negative magnetic toner.

15. The negative developing agent according to claim 12, wherein the inorganic oxide is attached to an exterior surface of the negative magnetic toner.

* * * * *